US008502097B2

(12) United States Patent
Aldana et al.

(10) Patent No.: US 8,502,097 B2
(45) Date of Patent: Aug. 6, 2013

(54) BRIDGE STYLE PUSH-BUTTON WITH ANCHORING

(75) Inventors: Leonardo Aldana, Waterloo (CA); Felipe Oliveira Simoes, Kitchener (CA); Marc Élis Meunier, Kitchener (CA)

(73) Assignee: Research In Motion Limited, Waterloo (CA)

( * ) Notice: Subject to any disclaimer, the term of this patent is extended or adjusted under 35 U.S.C. 154(b) by 299 days.

(21) Appl. No.: 12/976,443

(22) Filed: Dec. 22, 2010

(65) Prior Publication Data

US 2012/0160640 A1 Jun. 28, 2012

(51) Int. Cl.

| | |
|---|---|
| ***H01H 1/64*** | (2006.01) |
| ***H01H 1/66*** | (2006.01) |
| ***H01H 9/02*** | (2006.01) |
| ***H01H 9/06*** | (2006.01) |
| ***H01H 13/00*** | (2006.01) |
| ***H01H 19/04*** | (2006.01) |
| ***H01H 19/08*** | (2006.01) |
| ***H01H 21/00*** | (2006.01) |

(52) U.S. Cl.
USPC ..... 200/293

(58) Field of Classification Search
USPC ..... 200/5 A, 341, 329, 343, 344, 520, 200/521
See application file for complete search history.

(56) References Cited

U.S. PATENT DOCUMENTS

| | | | | |
|---|---|---|---|---|
| 6,002,093 | A * | 12/1999 | Hrehor et al. | 200/345 |
| 6,160,232 | A | 12/2000 | Lin | |
| 6,737,596 | B1 * | 5/2004 | Hein | 200/310 |
| 6,765,158 | B1 * | 7/2004 | Morrison et al. | 200/5 R |
| 7,479,868 | B2 | 1/2009 | Rose | |
| 7,576,291 | B2 * | 8/2009 | Tseng et al. | 200/296 |
| 7,671,291 | B2 * | 3/2010 | Odanaka | 200/345 |
| 7,683,278 | B2 | 3/2010 | Kakita et al. | |
| 2008/0055253 | A1 | 3/2008 | Moosavi et al. | |
| 2009/0090607 | A1 | 4/2009 | Ichikawa et al. | |
| 2009/0272639 | A1 | 11/2009 | Mittleman et al. | |
| 2009/0301852 | A1 | 12/2009 | Keist et al. | |
| 2010/0084251 | A1 | 4/2010 | Rajagopal et al. | |
| 2010/0213043 | A1 * | 8/2010 | Chen et al. | 200/5 A |

OTHER PUBLICATIONS

Creative Technical Solutions, Date unknown, http://burnettconsulting.com/creativel_solutions.htm.

Jawbone2 Repair the stuck or unresponsive button—YouTube video, http://www.youtube.com/watch?v=m_qHyhODPrg.

* cited by examiner

*Primary Examiner* — Edwin A Leon

*Assistant Examiner* — Anthony R. Jimenez

(74) *Attorney, Agent, or Firm* — MBM Intellectual Property Law, LLP

(57) ABSTRACT

The present technology provides a bridge-style push-button with anchoring, a device comprising same, and a method of assembly. The push-button comprises a first anchor portion for coupling to the device, a second anchor portion for coupling to the device, a resilient bridge portion suspended between the anchor portions, and an actuating portion mounted on the bridge portion. The first anchor portion is mounted along a differently oriented axis from the second anchor portion. The first and second anchor portions may be slideably mounted, rotatably mounted, or both. The device comprises anchor sites for mounting of the push-button. The method of assembly comprises coupling the first anchor portion to the device before the second anchor portion.

19 Claims, 6 Drawing Sheets

BRIDGE STYLE PUSH-BUTTON WITH ANCHORING

CROSS-REFERENCE TO RELATED APPLICATIONS

This is the first application filed for the present technology.

TECHNICAL FIELD

The present disclosure relates generally to push-buttons for actuating switches, and, in particular, to a push-button having a resilient bridge portion and an actuating portion mounted thereon.

BACKGROUND

Mass-manufactured electronic devices, as well as other devices, often incorporate mechanical means for user input such as push-buttons, dials, switches, and the like. Designers are often faced with the task of providing inputs that meet requirements or guidelines related to factors such as tactile response, functionality and cost. Due to inherent variability in the process of manufacturing devices assembled out of a number of different components, it may be difficult to provide a push-button design that reliably provides a desired tactile behaviour, avoids binding, and can be manufactured and installed with sufficient ease and within cost parameters.

A number of prior art push-button designs are available, each offering a different set of characteristics in terms of such factors as visual appeal, functionality, tactile behaviour, robustsness to manufacturing variability, cost, footprint, space, ease of installation, serviceability, resistance to binding, and the like. However, a number of scenarios remain in which it would be desirable to provide a push-button, but for which no available push-button design is adequate.

Therefore there is a need for a new push-button that overcomes one or more limitations of the prior art.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

Figure 1:
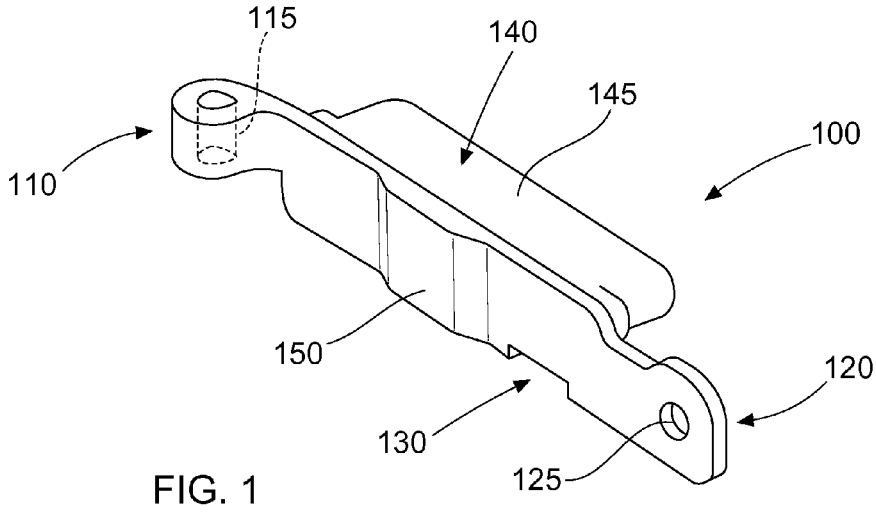
FIG. 1 illustrates a push-button for a device, in accordance with embodiments of the present technology.

The present technology generally provides a bridge-style push-button with anchoring as described herein, a device comprising same, and a method of manufacturing such a device, particularly in attaching the push-button and the device.

Accordingly, an aspect of the present technology provides a push-button for a device, for example a mobile electronic device. The push-button comprises a first anchor portion for coupling to the device at a first location. In some embodiments, the first anchor portion may be configured for slideably engaging a protrusion, such as a post or slotted post, extending from the device in a first direction, for rotatably engaging the protrusion, or both. The push-button further comprises a second anchor portion for coupling to the device at a second location. In some embodiments, the second anchor portion may be configured for slideably engaging another protrusion, such as a post or slotted post, extending from the second location, for rotatably engaging the protrusion, or both. The push-button further comprises a bridge portion, made of a resilient material, coupled to the first anchor portion and the second anchor portion. The bridge portion extends between the anchor portions along a second direction, which may be substantially perpendicular to the first direction, that is, the direction in which the protrusion, engaged by the first anchor portion, extends. The push-button further comprises an actuating portion mounted on the bridge portion, for example substantially mid-way between the two anchor portions. The actuating portion is accessible to a user for movement, for example by finger press, in an actuation direction. In some embodiments, the actuation direction is substantially perpendicular to both the first direction and the second direction. The actuating portion is movable between a rest position and an engaged position, and is biased by the resilient bridge portion toward the rest position. When mounted to the device, the actuating portion is configured, when moved to the engaged position, for actuating a switch, also coupled to the device.

Another aspect of the present technology provides a push-button for a device, the push-button comprising: a first anchor portion for coupling to a first protrusion extending from the device in a first direction; a second anchor portion for coupling to a second protrusion extending from the device in a second direction, the second direction different from the first direction; a resilient bridge portion coupled to the first anchor portion and the second anchor portion, the bridge portion extending between the first anchor portion and the second anchor portion; and an actuating portion mounted on the bridge portion and movable between a rest position and an engaged position, the actuating portion biased toward the rest position, the actuating portion configured, in the engaged position, for actuating a switch coupled to the device. The first and second protrusions may be oriented perpendicular to each other, substantially perpendicular, for example within 5 degrees or within 10 degrees of perpendicular, or they may be otherwise differently oriented.

Another aspect of the present technology provides a device, such as an electronic device or mobile electronic device, comprising a push-button. The device comprises a housing, such as a plastic or metal housing. The device further comprises a first anchor site, which comprises a protrusion contained in an interior of the housing. The protrusion extends from the housing, or other internal device component, in a first direction. The device further comprises a second anchor site located in the interior of the housing, for example extending from the housing into the interior. The device further comprises an aperture defined by the housing. The aperture is located between the first anchor site and the second anchor site and may communicate between the interior of the housing and an exterior of the housing. The device further comprises a switch located in the interior of the housing. The switch may be a standard switch, such as a dome switch, Microswitch™, spring contact switch, or other electromechanical switch, configured to change states when pressingly engaged, for example. The device further comprises a push-button. The push-button comprises a first anchor portion which, in some embodiments, may be configured for slideably engaging the protrusion. The push-button further comprises a second anchor portion for coupling to the second anchor site. The push-button further comprises a resilient bridge portion extending between the first anchor portion and the second anchor portion along a second direction. The second direction may be substantially perpendicular to the first direction. The push-button further comprises an actuating portion mounted on the bridge portion, for example located within the aperture. The actuating portion is accessible to a user, for example via the aperture for movement in an actuation direction between a rest position and an engaged position. In some embodiments, the actuation direction may be substantially perpendicular to both the first direction and the second direction. The actuating portion is biased by the resilient bridge portion, for example due to elastic properties, toward the rest position. The actuating portion is configured, when moved to the engaged position, for actuating the switch.

Yet another aspect of the present technology provides a method of attaching a push-button to a device. The method comprises accessing an interior of the device, the interior comprising a first anchor site and a second anchor site. The first anchor site comprises a protrusion located in the interior, the protrusion extending in a first direction. The push-button comprises a first anchor portion configured for slideably engaging the protrusion, a second anchor portion for coupling to the second anchor site, a resilient bridge portion extending between the first anchor portion and the second anchor portion, and an actuating portion mounted on the bridge portion. The method further comprises attaching the first anchor portion to the protrusion, for example by sliding the protrusion into an aperture defined by the first anchor portion, the aperture configured to receive the protrusion. The method subsequently comprises attaching the second anchor portion to the second anchor site and locating the actuating portion in an aperture defined by a housing of the device. The second anchor site may comprise a post or boss for engaging an aperture defined by the second anchor portion, and the second anchor portion may be attached to the second anchor site for example by heat staking. The attached first anchor portion thereby holds the push-button in place to facilitate subsequent attachment of the second anchor portion.

As used herein, a push-button refers to a user-actuatable interface, which may be actuated in a predetermined manner to initiate a predetermined function. The push-button may be used as an intermediary between a user's finger and an electronic device, such as a dome switch, Microswitch™, spring contact switch, or other electromechanical switch, interior to the device. A push-button is typically accessible to a user, for example by mounting so that an actuating portion of the push-button protrudes from the host device housing. The push-button may be accessible directly or through an intermediary such as a membrane layer, waterproof layer, decorative flexible coating, or the like. A push-button need not be limited to actuation by pressing in a predetermined direction, but may be actuatable by pushing the actuating portion of the button in one or more directions, or by twisting the actuating portion about an axis, or the like.

As used herein, a device may be an electronic device such as a pager, cellular phone, smart-phone, wireless organizer, personal digital assistant, headset such as a Bluetooth™ headset, computer, camera, or the like. Such devices typically have one or more user interface capabilities, such as one or more push-buttons as described herein, optionally along with other interfaces as would be readily understood by a worker skilled in the art.

FIG. 1 illustrates a push-button 100 for a device, in accordance with embodiments of the present technology. The push-button 100 comprises a first anchor portion 110, a second anchor portion 120, a bridge portion 130 and an actuating portion 140. The first anchor portion 110 defines an aperture 115 for receiving a protrusion of the device, and the second anchor portion 120 defines an aperture 125 for receiving another protrusion of the device. As illustrated, the two apertures 115 and 125 are substantially perpendicular to each other, for receiving corresponding perpendicular protrusions.

In some embodiments, each of the apertures 115 and 125 may be provided deviated from their substantially perpendicular configuration in one or more predetermined directions, for example by rotation of up to 5 degrees of an axis passing through the centre of one or more of the apertures 115 and 125, to receive correspondingly oriented protrusions. In some embodiments, the apertures may be so deviated when the resilient material of the push-button is in a rest position, that is, under no substantial elastic deformation. In some embodiments, flexible portions of the push-button, such as the bridge portion may be deformable, thereby facilitating absorption of manufacturing variations, such as variations in alignment or positioning of the anchor sites or protrusions thereof, or variations in the push-button, for example in spacing or alignment of the anchor portions. Potential deviation due to elastic deformation may be substantially more than 5 degrees.

Continuing with respect to FIG. 1, the bore of the aperture 115 as illustrated is also relatively long compared with the bore of the aperture 125. This may facilitate increased support of the first anchor portion when coupled to the device. The bridge portion 130 extends between the two anchor portions 110 and 120. The bridge portion 130, when anchored by the two anchor portions 110 and 120, supports an actuating portion 140 located substantially in the middle of the bridge portion 130. The actuating portion 140 comprises a user interface portion 145, such as a key cap, and a switch interface portion 150. The actuating portion 140 may be movable by user action to actuate a switch. The bridge portion 130 is flexible and resilient, thereby allowing movement of the actuating portion and biasing the actuating portion toward a rest position, wherein the push-button is shaped substantially as shown.

In some embodiments, each of the first and second anchor portions 110 and 120 may be rotatable relative to their corresponding anchor sites, slideable relative to their corresponding anchor sites, or both. For example, the first anchor portion 110 may be slideable on a protrusion of its anchor site, and the second anchor portion 120 may be rotatable relative to its anchor site. A predetermined degree of mobility of one or more anchor portions may facilitate absorption of manufacturing variances, resistance to binding of the button, improved user experience, or the like, or a combination thereof.

Figure 2:
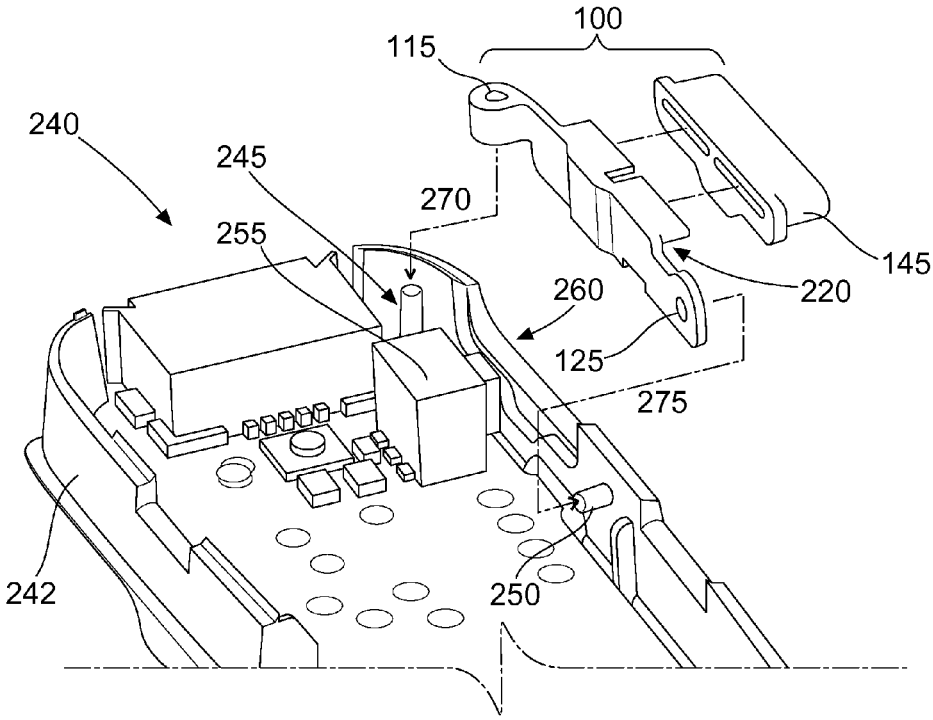
FIG. 2 illustrates an exploded view of a device comprising a push-button and a method of attaching the push-button to the device, in accordance with embodiments of the present technology.

FIG. 2 illustrates an exploded view of a device 240 comprising a push-button 100, in accordance with embodiments of the present technology. The push-button 100 is formed of a user interface portion 145 and a flexible, resilient portion 220. The key cap portion 145 may be made of a substantially rigid material, such as hard plastic. In some embodiments, the user interface portion 145 and the resilient portion 220 may be formed together, for example in a two-shot moulding process, as would be readily understood by a worker skilled in the art, or the user interface portion 145 may be attached to the resilient portion 220 in an assembly operation. For the assembled device and push-button, an aperture 115 of the push-button receives a protrusion 245 of the device 240, for example the aperture 115 frictionally engaging the protrusion 245. Another aperture 125 of the push-button receives another protrusion 250 of the device 240. The protrusion 250 may be deformed under heat and pressure in a heat staking process to impede subsequent removal of the protrusion 250 from the aperture 125, thereby capturing the push-button 100.

The device 240 comprises a housing section 242 into which an aperture 260 is formed. For the assembled device and push-button, the user interface portion 145 of the push-button is located within the aperture 260 and extends outward from the housing section 242 for user access. The device 240 may further comprise another housing section (not shown) which is fitted with the housing section 242 to provide an enclosure for the device 240 after push-button attachment. The device 240 further comprises a switch 255, for example mounted on a circuit board within the device housing section 242. The switch is located in line with the actuating portion, such that pressing the push-button will mechanically actuate the switch 255.

FIG. 2 also illustrates a method of attaching the push-button 100 to the device 240, in accordance with embodiments of the present technology. First, the aperture 115 is fitted over the protrusion 245, as indicated by arrow 270. Subsequently, the aperture 125 is fitted over the protrusion 250, as indicated by the arrow 275. The push-button may then be captured, for example by deforming the protrusion 250 by heat staking.

Figure 3:
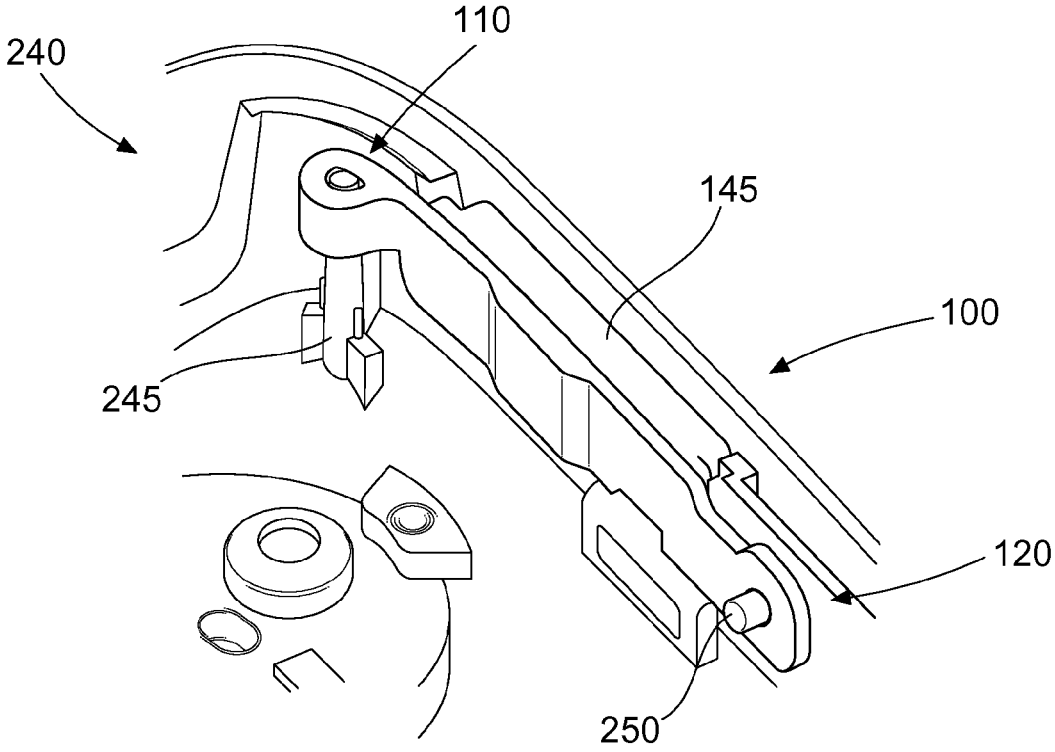
FIG. 3 illustrates a partial view of a device comprising a push-button, in accordance with embodiments of the present technology.

FIG. 3 illustrates a partial view of a device 240 comprising a push-button 100 attached thereto, in accordance with embodiments of the present technology. As illustrated, a protrusion 245 of a first anchor site of the device 240 is fitted within an aperture of the first anchor portion 110 of the push-button 100, and a protrusion 250 of a second anchor site of the device 240 is fitted within an aperture of the second anchor portion 120 of the push-button 100. The user interface portion 145 extends through an aperture of the device housing to the exterior of the device 240. The protrusion 250 may be subsequently deformed by heat staking to capture the button 100, or another method may be used to capture the button 100, for example by screwing a cap to the end of the protrusion 250, by applying an adhesive to the end of the protrusion 250 to form an enlarged end, or the like. In some embodiments, the protrusion 245 of the first anchor site may also be similarly modified to capture the button 100, however in other embodiments there is no substantial modification of the protrusion 245 of the first anchor site. Rather, the first anchor portion 110 may be slideable, rotatable, or both, to at least a predetermined degree relative to the protrusion 245.

In some embodiments, the protrusion 245 of the first anchor site facilitates a reduction in sagging of the installed button. The protrusion 245 facilitates supporting and pulling of the push-button 100 so that the actuating portion 140 is biased toward the device aperture 260, thereby reducing the chance of the button 100 sagging in from the aperture.

Figure 4:
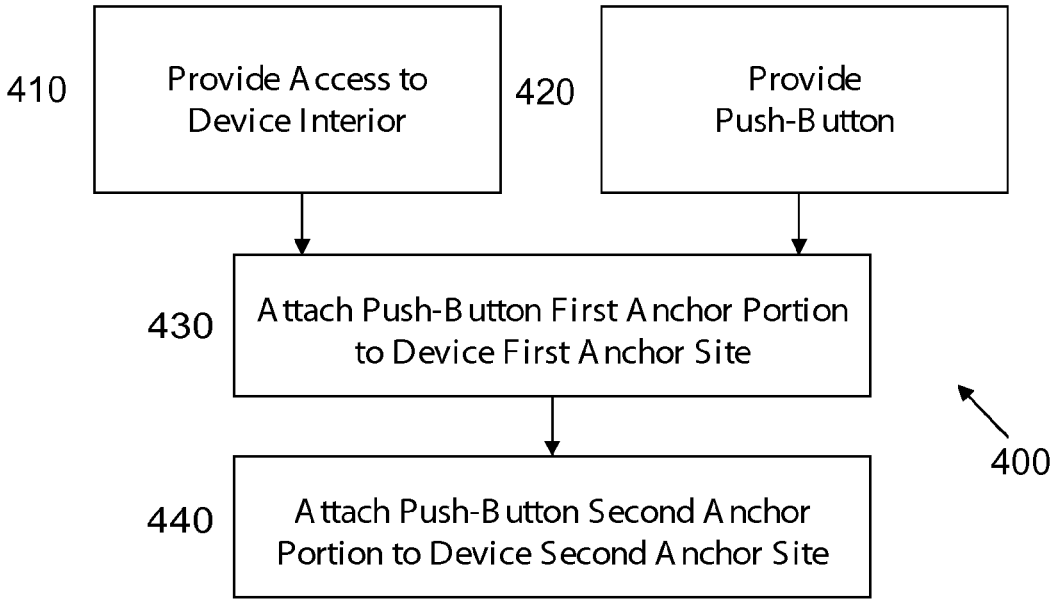
FIG. 4 illustrates a method of attaching a push-button to a device, in accordance with embodiments of the present technology.

FIG. 4 illustrates a method 400 of attaching a push-button to a device, in accordance with embodiments of the present technology. The method 400 comprises providing 410 access to the device interior, and in particular to anchor sites thereof, the device as described elsewhere herein. The method 400 further comprises providing 420 a push-button as described elsewhere herein. That is, the push-button comprises first and second anchor portions, a resilient bridge portion and an actuating portion. The method 400 further comprises attaching 430 the first anchor portion of the push-button to the first anchor site of the device. The method 400 further comprises subsequently attaching 440 the second anchor portion of the push-button to the second anchor site of the device. Attaching 440 of the second anchor portion to the second anchor site may comprise capturing the push-button by heat staking. The method may further comprise further device assembly operations before or after those described above, for example to attach separate portions of the device housing together to provide an enclosure of the device.

In embodiments of the present technology, the first anchor portion of the push-button is coupled to a protrusion, such as a post, pin or boss, extending from the device in a first direction, and the second anchor portion of the push-button is coupled to a protrusion extending from the device in a direction from, for example substantially orthogonal to, the first direction. The use of two differently oriented protrusions, or more generally the use of differently oriented anchor portions and anchor sites, may facilitate providing several desirable features related to the push-button. For example, the two differently oriented protrusions to which the push-button is anchored may facilitate one or more of: an improved tactile experience associated with use of the button, a reduction in binding of the button; a reduction in sagging of the bridge portion; an improved assembly process in attaching the button and the device; an improvement in tolerances to manufacturing misalignments; a reduced impact of manufacturing and assembly variability to push-button operation; and other advantages as will be made apparent herein.

In some embodiments, use of differently oriented protrusions, or more generally differently oriented anchor axes of the first and second anchor portions, may facilitate absorption of manufacturing variances, thereby increasing allowable manufacturing tolerances of the device, push-button, or combination thereof. The differently oriented pins may facilitate at least a partial decoupling of effects of manufacturing variability. For example, due to different orientations, misalignment of one protrusion, anchor axis, anchor site, or a combination thereof, may have a different effect from misalignment of another protrusion, anchor axis, anchor site, or a combination thereof. Therefore plural misalignments may not superimpose to create tolerance stack-ups in the same way as if the anchor axes or protrusions were substantially parallel.

For example, in some embodiments, a first set of one or more manufacturing variabilities associated with a first anchor portion, anchor site, or both, may primarily affect alignment of the push-button actuation portion within the device aperture in a first way, for example corresponding to alignment in the direction of the protrusion of the first anchor site. Likewise, a second set of one or more manufacturing variabilities associated with a second anchor portion, anchor site, or both, may primarily affect alignment of the push-button actuation portion within the device aperture in a second way, for example corresponding to alignment in the direction of the protrusion of the second anchor site. Since the first anchor portion and anchor site correspond to a different anchor axis orientation from the second anchor portion and anchor site, the first and second manufacturing variabilities may be substantially different, for example, they may not superimpose, reinforce each other or stack up in the same manner as if the anchor axes were oriented similarly. For example, an abrasion force due to the push-button actuation portion contacting an edge of the device aperture may be substantially affected by one of the first and second manufacturing variabilities, but substantially less by the other. In embodiments of the present technology, this allows the device, push-button, or both to be manufactured with substantially relaxed tolerances over the case where the anchor axes are oriented similarly.

In embodiments of the present technology, one or more anchor portions of the push-button may be slideably coupled, rotatably coupled, or a combination thereof, to the corresponding anchor sites of the device, for example to protrusions thereof. This may further contribute to one or more improvements or advantages of the present technology, such as those described above and elsewhere herein. For example, this may facilitate absorption of manufacturing variances, improve button mobility and resistance to binding, improve user tactile experience, or the like, or a combination thereof.

For example, in some embodiments, the first anchor portion is slideable relative to the first anchor site, and the second anchor portion is rotatable relative to the second anchor site. This may facilitate a predetermined freedom of movement of the push-button actuating portion within an aperture of the device housing, to facilitate placement of the actuating portion within the aperture with reduced tendency toward binding or catching.

Figure 5A:
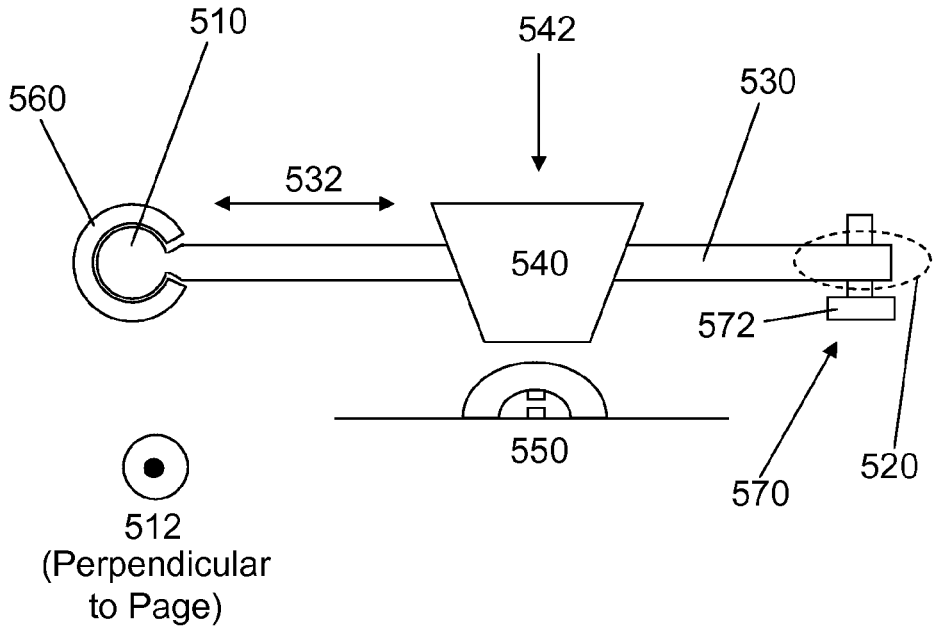
FIG. 5A illustrates a push-button in a rest position, in accordance with embodiments of the present technology.
Figure 5B:
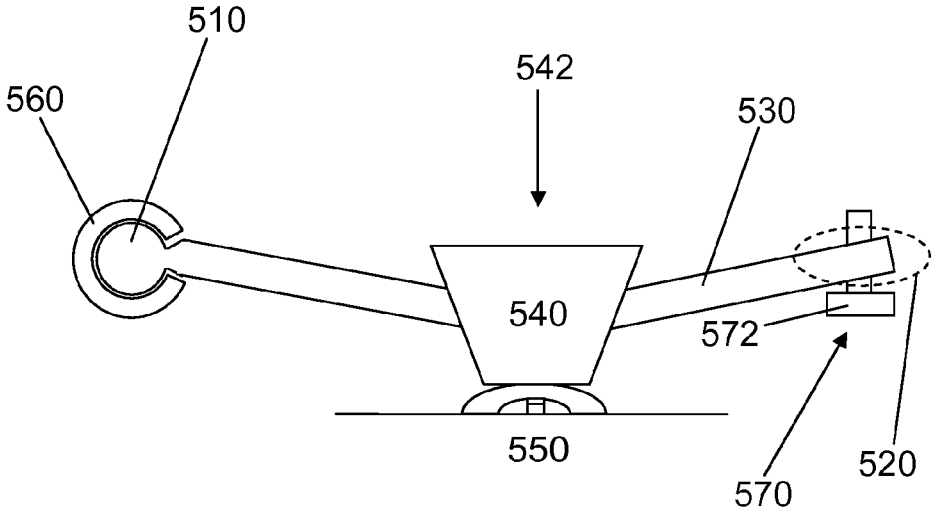
FIG. 5B illustrates the push-button of FIG. 5A in an engaged position, in accordance with embodiments of the present technology.

FIG. 5A illustrates a push-button in a rest position, in accordance with embodiments of the present technology. FIG. 5B illustrates the push-button of FIG. 5A in an engaged position. The push-button comprises a first anchor portion 510, which, as illustrated, is a cylindrical body received within a hollow C-shaped post 560 of the first anchor site. The post 560 extends in a first direction 512, perpendicular to the page. The push-button comprises a second anchor portion 520, which comprises an aperture receiving a post 570 of the second anchor site. The post 570 extends in the actuation direction 542, which is the direction of travel of the push-button actuation portion 540. A cap 572 is formed on the post 570 to capture the button. The push-button further comprises a resilient bridge portion 530, which generally extends in a second direction 532, which is substantially perpendicular to the first direction 512 and the actuation direction 542. The bridge portion 530 is deformable by bending, stretching, or a combination thereof, but is resilient so as to be biased to return to the rest position of FIG. 5A. The push-button actuation portion 540 is accessible to a user and movable in the actuation direction 542 to actuate a switch 550 mounted on the device. As illustrated, the actuation portion 540 is not in contact with the switch 550 when in the rest position. However, in some embodiments, the actuation portion 540 may be in contact with the switch 550 even in the rest position, although not applying sufficient pressure to operate the switch 550. FIG. 5B illustrates the push-button with the actuation portion 540 moved to the engaged position to operate the switch 550. The resilient bridge portion 530 deforms to allow the movement, while the anchor portions 510 and 520 are inhibited from moving by the anchor sites 560 and 570, respectively, thereby causing tension in the bridge portion 530 which biases the actuation portion 540 back to the rest position. In some embodiments, the switch 550 may also contribute to biasing the actuation portion toward the rest position, due to resilience or spring action of the switch.

First Anchor Portion

The push-button comprises a first anchor portion for coupling to a corresponding first anchor site of the device. For example, the first anchor portion may comprise a body defining an aperture which is sized, shaped and oriented for receiving a protrusion such as a post, boss, screw, or the like. As another example, the first anchor portion may comprise a tab, for example a substantially cylindrically shaped tab attached to the remainder of the push-button along an arcuate portion of the cylinder, which is configured to fit into an aperture of a protrusion coupled to the device at the first anchor site. Other configurations may also be implemented.

In some embodiments, the aperture defined by the first anchor portion or first anchor site may be substantially cylindrically shaped, conically shaped, or the like, thereby enabling relative rotation of the first anchor portion and the first anchor site. In some embodiments, the aperture may be shaped with one or more edges, thereby substantially impeding relative rotation of the first anchor portion and the first anchor site.

In some embodiments, the first anchor portion may be configured for frictionally engaging the protrusion of the first anchor site, thereby holding the first anchor portion in place. The degree of frictional engagement may optionally allow for relative rotation of the first anchor portion and first anchor site. In some embodiments, the first anchor portion, is made of a resilient material and may be configured so that the first anchor portion must be stretched to expand the aperture to receive the protrusion of the first anchor site, the resilient material then biased to grippingly engage the protrusion within the aperture. This may inhibit sliding, rotation, or both, of the first anchor portion, to a predetermined degree. The bridge portion, being of a resilient material and therefore able to bend, may allow for deformation of the push-button when the first anchor portion is non-rotatably engaged with the first anchor site.

In some embodiments, the first anchor portion may be slideably engaged with the protrusion, rotatably engaged with the protrusion, or a combination thereof. This may facilitate providing the push-button with a predetermined amount of positional freedom for appropriately locating it on the device, thereby improving push-button response, reducing binding, and improving manufacturing tolerances.

The protrusion of the first anchor site defines a first anchor axis, this first anchor axis corresponding to the general direction in which the protrusion protrudes. The aperture or tab of the first anchor portion is oriented to be parallel to the first anchor axis when coupling to the first anchor site. The orientation of the first anchor axis is relevant to one or more aspects of the present technology. For example, the first anchor portion may be slideable relative to the protrusion in a direction parallel to the first anchor axis. As another example, the first anchor portion, coupled at the first anchor site, may resist pulling force applied in directions substantially radiating from the first anchor axis, for example those directions in a plane substantially perpendicular to the first anchor axis. As yet another example, the first anchor portion may be rotatable or pivotable about the first anchor axis, which is thereby also a pivot axis.

Second Anchor Portion

The push-button comprises a second anchor portion for coupling to a corresponding second anchor site of the device. For example, the second anchor portion may comprise a body defining an aperture which is sized, shaped and oriented for receiving a protrusion such as a post, boss, screw, or the like. As another example, the second anchor portion may comprise a tab, for example a substantially cylindrically shaped tab attached to the remainder of the push-button along an arcuate portion of the cylinder, which is configured to fit into an aperture of a protrusion coupled to the device at the second anchor site.

In some embodiments, the second anchor portion may comprise a body defining an aperture, the aperture configured to receive a protrusion, of the second anchor site, protruding from the device, for example in a direction substantially parallel to the actuation direction of the push-button. The protrusion may coupled to the second anchor portion by heat staking, wherein the protrusion is inserted through the aperture and deformed under heat and pressure, for example to bend the protrusion, form an enlarged end, or the like, thereby capturing the second anchor portion. Alternatively, the second anchor portion may be captured in another manner, for example by screwing or otherwise attaching a cap to the protrusion.

In some embodiments, a protrusion of the second anchor site defines a second anchor axis, this second anchor axis corresponding to the general direction in which the protrusion protrudes. The aperture or tab of the second anchor portion is oriented to be parallel to the second anchor axis when coupling to the second anchor site. The orientation of the second anchor axis is relevant to one or more aspects of the present technology. For example, the second anchor portion may be slideable relative to the protrusion in a direction parallel to the second anchor axis. As another example, the second anchor portion, coupled at the second anchor site, may resist pulling force applied in directions substantially radiating from the second anchor axis, for example those directions in a plane substantially perpendicular to the second anchor axis. As yet another example, the second anchor portion may be pivotable or rotatable about the second anchor axis, for example by an aperture of the second anchor portion substantially loosely engaging a protrusion of the second anchor site.

In some embodiments, the second anchor portion may be slideably engaged with the second anchor site, rotatably engaged with the second anchor site, or a combination thereof. This may facilitate providing the push-button with a predetermined amount of positional freedom for appropriately locating it on the device, thereby improving push-button response, reducing binding, and improving manufacturing tolerances. In some embodiments, the slideability, rotatability, or both, of the second anchor portion may be in a substantially different direction than that of the first anchor portion. For example, this may facilitate a reduction in tolerance stack-up associated with the device and push-button assembly.

In accordance with embodiments of the present technology, the first anchor axis and the second anchor axis may be substantially perpendicular. In some embodiments, each anchor axis may be offset from a pair of corresponding perpendicular reference axes by up to a nominal amount in one or more direction. In some embodiments, this nominal amount may be five degrees. In some embodiments, this nominal amount may be ten degrees.

Bridge Portion

The push-button comprises a bridge portion, made of resilient material such as rubber, flexible and resilient plastic, rubberized plastic, resilient metal, or the like. The bridge portion is configured to flex when pressure is applied by user action to push the button, thereby allowing movement of the actuating portion. The bridge portion is biased, at least in part due to the resilient material, to return the actuating portion to a rest position when such pressure is released.

Actuating Portion

The push-button comprises an actuating portion, which is mounted on the bridge portion. The actuating portion may be at least in part integrally formed with the bridge portion, co-moulded with the bridge portion, or attached to the bridge portion by friction fit, adhesives, or other means. The actuating portion may operate as the push-button proper, being accessible to a user for movement in an actuation direction between a rest position and an engaged position. The actuating portion is biased, at least in part by the resilient bridge portion, toward the rest position. The actuating portion is configured, when moved to the engaged position under user applied pressure, for actuating a switch coupled to the device.

The actuating portion may further comprise a user interface portion. The user interface portion may protrude from or be accessible via an aperture in the device when the push-button is installed. The user interface portion may comprise a key cap, for example made of hard plastic, coupled to the push-button for example by co-moulding.

The actuating portion may further comprise a switch interface portion. The switch interface portion may protrude inward from the bridge portion toward a switch coupled to the device interior, thereby reducing the amount of travel required in the actuation direction to actuate the switch, and providing a targeted point of contact for actuating the switch. The switch interface portion may comprise a resilient material or hard material, such as hard plastic. In some embodiments, the switch interface portion may comprise a conductive surface, for example comprising one or more conductors or electric circuits, the conductive surface configured to complete a circuit of the switch when engaged to the switch, thereby operating the switch. In these embodiments, the actuating portion may be configured to be spaced apart from the switch when in the rest position to break the circuit.

Push-Button Materials and Manufacture

In some embodiments, the push-button is integrally formed out of a single, resilient material such as rubber, flexible plastic, rubberized plastic, or the like.

In some embodiments, some portions of the push-button are integrally formed out of a single, resilient material, and other portions are made of a different material, such as hard plastic. The different portions may be coupled for example by co-moulding or two-shot moulding, or mechanically fastening by screws, adhesive, or the like, as would be readily understood by a worker skilled in the art.

Device With Push-Button

Aspects of the present technology relate to a device comprising a push-button as described herein. For example, the device may be an electronic device such as a pager, cellular phone, smart-phone, wireless organizer, personal digital assistant, headset such as a Bluetooth™ headset, computer, camera, or the like. An electronic device may comprise components such as circuit boards, audio inputs, audio outputs, video inputs, video outputs, keyboards, power supplies, signal ports, radio transceivers, memory, computer processors, other electronics, and the like, as would be readily understood by a worker skilled in the art. A push-button as described herein may be the sole mechanical interface of the device, or it may be one of several such interfaces.

In some embodiments, the push-button may be located near a corner of the device, with the differently oriented protrusions extending from differently oriented surfaces of the device housing. In other embodiments, the differently oriented protrusions may extend from differently oriented structures such as internal braces, ribs, or other portions of the device. In still other embodiments, one or more of the protrusions may comprise bends to align them to different orientations.

In some embodiments, the device housing may be formed from moulded plastic, as would be readily understood by a worker skilled in the art. Protrusions of the first and second anchor sites, or other features, may be integrally formed with the device housing or mechanically coupled to the device housing or other internal device portions, for example by screwing posts into apertures formed in the housing. An aperture in the device housing may also be formed as part of the housing moulding process. The device housing may be configured with posts or other supports for receiving device components therein, such as the switch engaged by the push-button, and other electronics and components relevant to device functionality. Other methods for forming the device structure may also be used, as would be readily understood by a worker skilled in the art.

Manufacture of Device With Push-Button

In accordance with an aspect of the present technology, there is provided a method of attaching the push-button to the device.

The method comprises accessing an interior of the device, for example including receiving the device in a partially unassembled state. For example, the device may comprise two or more housing portions which snap together, and accessing the device interior may comprise providing the separate housing portions. The device interior comprises a first anchor site and a second anchor site, for example located in one of the housing portions. The first anchor site comprises a protrusion located in the device interior, the protrusion extending in a first direction.

The method further comprises providing a push-button comprising a first anchor portion configured for slideably engaging the protrusion, a second anchor portion for coupling to the second anchor site, a resilient bridge portion extending between the first anchor portion and the second anchor portion, and an actuating portion mounted on the bridge portion. The push-button is provided as a separate piece from the device.

The method further comprises attaching the first anchor portion to the first anchor site. For example, the protrusion may be slid into an aperture defined by the first anchor portion, or a tab of the first anchor portion may be slid into an aperture defined by the protrusion. In some embodiments, the protrusion may be oriented so that the first anchor portion remains attached without further measures being required, such as heat staking. For example, the protrusion may be oriented substantially perpendicular to the actuating direction. This may improve the assembly process by reducing the number of operations to capture the first anchor portion.

The method further comprises, subsequently to attaching the first anchor portion, attaching the second anchor portion to the second anchor site and locating the actuating portion in an aperture defined by the device. The second anchor portion may be attached to the second anchor site via heat staking or other means.

The first anchor portion, attached to the first anchor site, aids in holding the push-button in place relative to the device while the second anchor portion is attached. This facilitates the assembly process since the push-button is less likely to fall off the device during assembly. The orientation of the first anchor portion and first anchor site protrusion facilitates holding of the push-button in place while the second anchor portion is attached.

In accordance with another aspect of the present technology, there is provided a kit comprising one or more components of the device and one or more separate components of the push-button. The kit may further comprise instructions for attaching the push-button to the device, as described herein.

Figure 6:
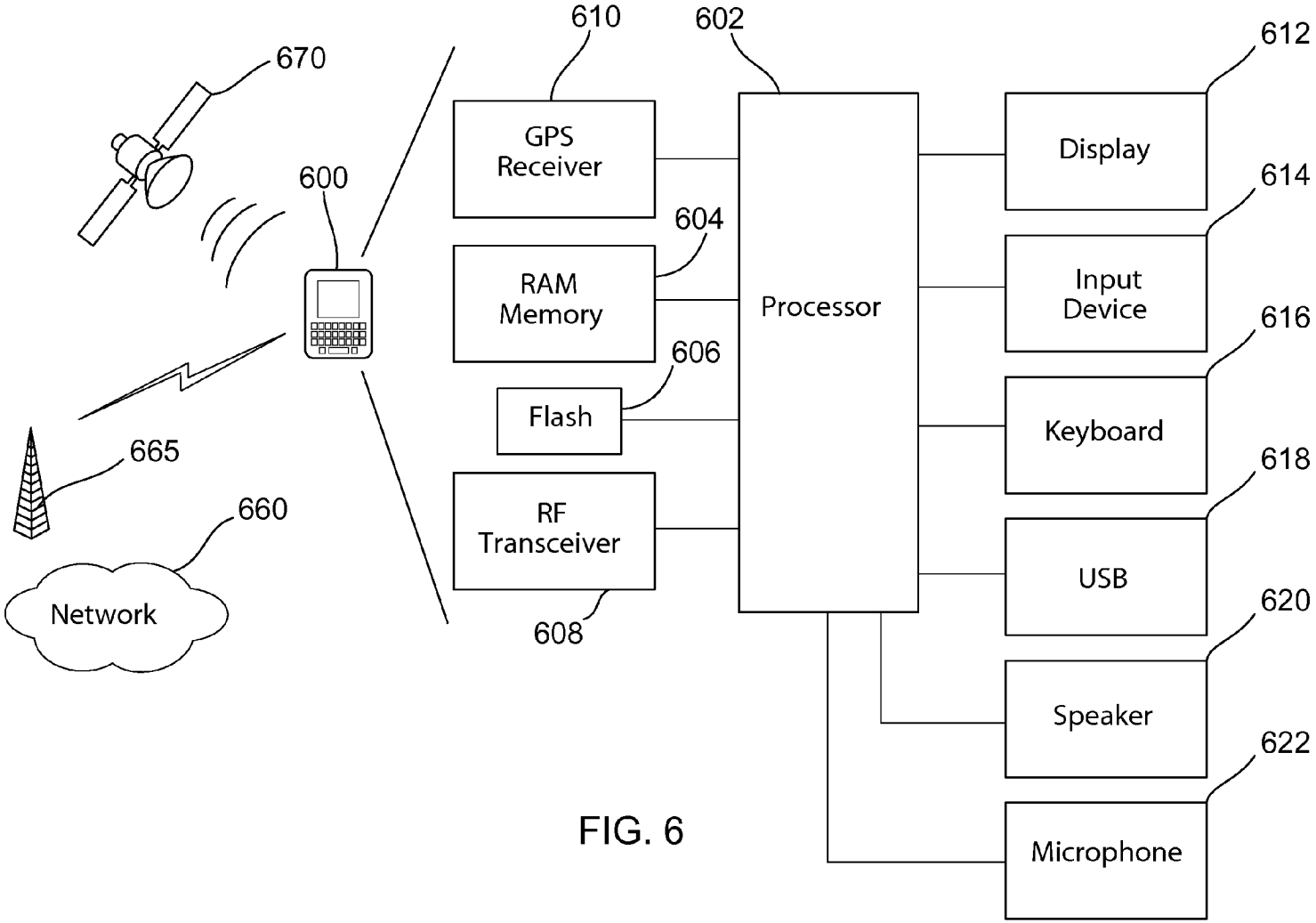
FIG. 6 illustrates a block diagram of an exemplary wireless communication device comprising a push-button, in accordance with embodiments of the present technology.

FIG. 6 is a block diagram depicting certain main components of an exemplary wireless communication device 600. It should be understood that this figure is intentionally simplified to show only certain components; the device 600 may include other components beyond those shown in FIG. 2. The device 600 includes a microprocessor 602 (or simply a "processor") which interacts with memory in the form of RAM 604 and flash memory 606 to enable a variety of device functions and to execute an operating system for running software applications loaded on the device. The device 600 includes a radiofrequency (RF) transceiver 608 for communicating wirelessly with a base station 665 of a wireless network 660, or alternatively or additionally for communicating directly with another peer device such as a wireless communication device, for example as may occur in some ad-hoc networks. The base station 665 may be a cellular base station, wireless access point, or the like. The base station 665 may change as the wireless communication device travels. The RF transceiver includes a wireless communication channel for transmitting and receiving data. The RF transceiver may further include a wireless voice channel for transmitting and receiving voice communications, for example concurrently with transmission and reception of data over the same or a separate logical or physical channel.

The device 600 optionally includes a GPS receiver chipset 610 for receiving GPS radio signals transmitted from one or more orbiting GPS satellites 670. The GPS receiver chipset 610 can be embedded within the device or externally connected, such as, for example, a "Bluetooth" GPS puck or dongle. Other positioning systems may also be used in place of GPS, as would be readily understood by a worker skilled in the art.

In terms of input/output devices or user interfaces (UI's), the device 600 typically includes a display 612 (e.g. a small LCD screen), a thumbwheel or trackball 614, a keyboard 616, which in some embodiments may be integrated or enabled using the display such as a touch screen display, a USB 618 or serial port for connecting to peripheral equipment, a speaker 620 and a microphone 622. The device's display 612 may optionally include a touch screen input device. The device 600 or user interface components thereof comprise one or more push-buttons as described herein in accordance with the present technology.

The wireless communication device 600 sends and receives communication signals via the RF transceiver 608. When communicating wirelessly with a base station 665 of a wireless network 660, the device 600 may communicate in accordance with one or more appropriate technologies such as: Global Systems for Mobile communications (GSM), General Packet Radio Service (GPRS), Code Division Multiple Access (CDMA) technologies, Wideband CDMA (WCDMA), whether 2G, 3G, High speed packet access (HSPA), Universal Mobile Telecommunication System (UMTS) based technologies, Long Term Evolution (LTE) technologies, Orthogonal Frequency Division Multiplexing (OFDM) technologies, Ultra-Wideband (UWB) technologies, WiFi or WiMAX technologies, or other communication technologies and protocols as would readily be understood by a worker skilled in the art. In some embodiments, the wireless device 600 may be capable of operation using multiple protocols. The base station 665 may be part of a wireless network, such as a cellular network, local-area network, wide-area network, wireless hotspot network, or the like. The wireless communication device, base station, network components, and the like, may be configured for data communication, voice communication, or a combination thereof, possibly using additional components, configurations and procedures where appropriate, such as SIM cards, authorization and authentication procedures, handoff procedures, and the like, as would be readily understood by a worker skilled in the art.

Figure 7A:
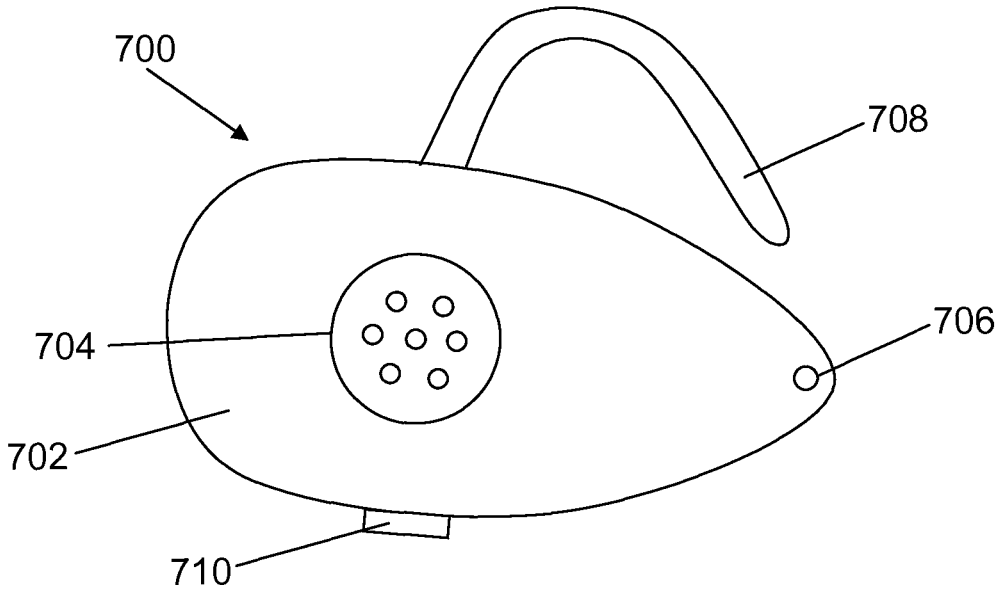
FIG. 7A illustrates an exemplary device comprising a push-button, in accordance with embodiments of the present technology.

FIG. 7A illustrates a wearable user interface device 700 such as a Bluetooth™ headset for use with a mobile phone or other device. The device 700 comprises a housing 702 containing electronic components such as microelectronics, analog components, and radiofrequency components, as would be readily understood by a worker skilled in the art. The device 700 further comprises an earpiece 704 having a speaker, a microphone 706, and an ear clip 708 for holding the device 700 in place on a wearer's ear. The device further comprises a push-button 710 operatively coupled to a switch (not shown), which is in turn operatively coupled to the device electronic components. The push-button 710 is a bridge-style push-button of the type described herein. One or more such push-buttons may be located at a plurality of locations of the housing 702.

Figure 7B:
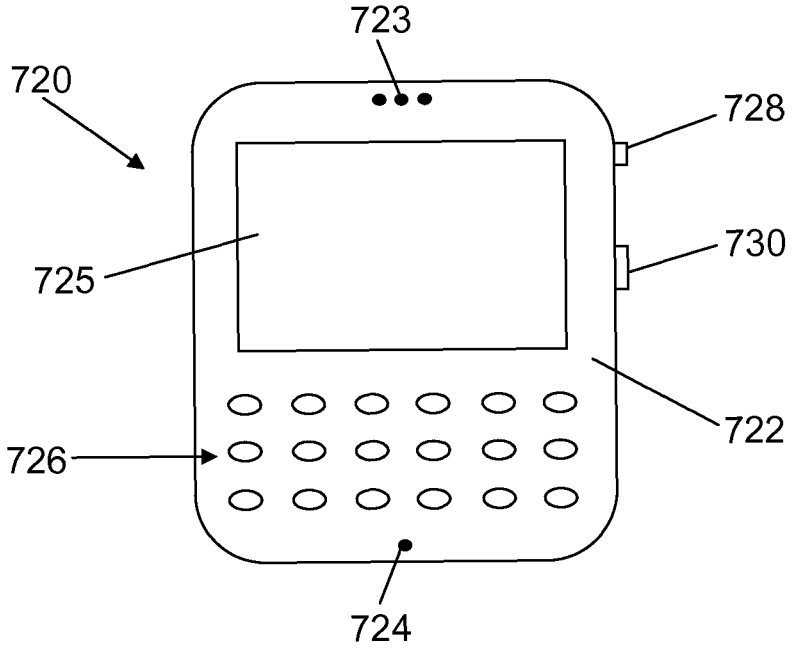
FIG. 7B illustrates another exemplary device comprising a push-button, in accordance with embodiments of the present technology.

FIG. 7B illustrates a wearable user interface device 720 such as a smartphone. The device 720 comprises a housing 722 containing electronic components such as microelectronics, analog components, and radiofrequency components, as would be readily understood by a worker skilled in the art. The device 700 further comprises an earpiece 723 having a speaker, a microphone 724, a video display 725, and a keypad 726. The device further comprises one or more push-buttons 728, 730 operatively coupled to one or more switches (not shown), which are in turn operatively coupled to the device electronic components. At least one of the push-buttons 728, 730 is a bridge-style push-button of the type described herein. Other push-buttons or portions of the keypad 726 may similarly be provided.

This new technology has been described in terms of specific implementations and configurations and variants thereof which are intended to be exemplary only. The scope of the exclusive right sought by the applicant is therefore intended to be limited solely by the appended claims.

The invention claimed is:

1. A push-button for a device, the push-button comprising:

a) a first anchor portion for coupling to the device at a first location, the first anchor portion configured for slideably engaging a protrusion extending from the device in a first direction;

b) a second anchor portion for coupling to the device at a second location;

c) a resiliently stretchable bridge portion coupled to the first anchor portion and the second anchor portion, the bridge portion extending along a second direction between the first anchor portion and the second anchor portion, the second direction substantially perpendicular to the first direction; and d) an actuating portion mounted on the bridge portion and accessible to a user for movement in an actuation direction between a rest position and an engaged position, the actuating portion biased toward the rest position by a tension induced within the resiliently stretchable bridge portion, wherein the first anchor portion and the second anchor portion are coupled to the device so as to resist against motion along the second direction, thereby providing said tension, the actuating portion configured, when moved to the engaged position, for actuating a switch coupled to the device.

2. The push-button according to claim 1, wherein one or both of the First anchor portion and the second anchor portion are rotatably coupled to the device.

3. The push-button according to claim 1, wherein the first anchor portion comprises an aperture for receiving the protrusion.

4. The push-button according to claim 1, wherein the first anchor portion comprises a tab configured to fit in an aperture of the protrusion.

5. The push-button according to claim 1, wherein the second anchor portion comprises an aperture for receiving a second protrusion extending from the device second location in a third direction substantially perpendicular to both the first direction and the second direction.

6. The push-button according to claim 5, wherein the actuation direction is substantially parallel to the third direction.

7. The push-button according to claim 1, wherein the push-button is formed as a two-shot moulded part.

8. A push-button for a device, the push-button comprising:

a) a first anchor portion for coupling to a first protrusion extending from the device in a first direction;

b) a second anchor portion for coupling to a second protrusion extending from the device in a second direction, the second direction different from the first direction;

c) a resiliently stretchable bridge portion coupled to the first anchor portion and the second anchor portion, the bridge portion extending between the first anchor portion and the second anchor portion; and d) an actuating portion mounted on the bridge portion and movable between a rest position and an engaged position, the actuating portion biased toward the rest position by a tension induced within the resiliently stretchable bridge portion, wherein the first anchor portion and the second anchor portion are coupled to the device so as to resist against motion along a direction in line with the resiliently stretchable bridge portion, thereby providing said tension, the actuating portion configured, in the engaged position, for actuating a switch coupled to the device.

9. The push-button according to claim 8, wherein the first direction and the second direction are configured to facilitate one or more of: an improved tactile experience associated with use of the push-button, a reduction in binding of the push-button; a reduction in sagging of the bridge portion; an improved assembly process in attaching the push-button and the device; an improvement in tolerances to manufacturing misalignments of the push-button; and an improvement in tolerances to manufacturing misalignments of the device.

10. The push-button according to claim 8, wherein one or both of the first anchor portion and the second anchor portion are rotatably coupled to the device.

11. The push-button according to claim 8, wherein the first anchor portion is slideably coupled to the device.

12. A device comprising:

a) a housing;

b) a first anchor site comprising a protrusion located in an interior of the housing, the protrusion extending in a first direction;

c) a second anchor site located in the interior of the housing;

d) an aperture defined by the housing and located between the first anchor site and the second anchor site;

d) a switch located in the interior of the housing; and e) a push-button comprising: a first anchor portion configured for slideably engaging the protrusion; a second anchor portion for coupling to the second anchor site; a resiliently stretchable bridge portion extending between the first anchor portion and the second anchor portion along a second direction substantially perpendicular to the first direction; and an actuating portion mounted on the bridge portion and accessible to a user for movement in an actuation direction between a rest position and an engaged position, the actuating portion biased toward the rest position by a tension induced within the resiliently stretchable bridge portion, wherein the first anchor portion and the second anchor portion are coupled to the first anchor site and the second anchor site, respectively, so as to resist against motion along the second direction, thereby providing said tension, the actuating portion configured, when moved to the engaged position, for actuating the switch.

13. The device according to claim 12, wherein the second anchor site comprises a second protrusion for insertion into an aperture of the second anchor portion, the second protrusion configured to be heat staked, thereby capturing the second anchor portion.

14. The device according to claim 12, wherein one or both of the first anchor portion and the second anchor portion are rotatably coupled to the device.

15. A method of attaching a push-button with a device, the method comprising:

a) accessing an interior of the device, the interior comprising a first anchor site and a second anchor site, the first anchor site comprises a protrusion located in the interior, the protrusion extending in a first direction;

b) providing the push-button, the push-button comprising a first anchor portion configured for slideably engaging the protrusion, a second anchor portion for coupling to the second anchor site, a resiliently stretchable bridge portion extending between the first anchor portion and the second anchor portion, and an actuating portion mounted on the bridge portion;

c) attaching the first anchor portion to the protrusion; and d) subsequently attaching the second anchor portion to the second anchor site and locating the actuating portion in an aperture defined by the device, wherein, following attachment, the actuating portion is biased toward the rest position by a tension induced within the resiliently stretchable bridge portion, and wherein the first anchor portion and the second anchor portion are attached to the protrusion and line with the resiliently stretchable bridge portion, thereby providing said tension.

16. The push-button according to claim 1, wherein the second anchor portion is configured for engaging a second protrusion extending from the device second location in a third direction substantially perpendicular to both the first direction and the second direction.

17. The push-button according to claim 8, wherein the second direction is substantially perpendicular to the first direction.

18. The device according to claim 12, wherein the second anchor site comprises a second protrusion extending from the device second location in a third direction substantially perpendicular to both the first direction and the second direction, and wherein the second anchor portion is configured for engaging the second protrusion.

19. The method according to claim 15, wherein the second anchor portion is configured for engaging a second protrusion extending from the device second location in a third direction substantially perpendicular to both the first direction and the direction in line with the resiliently stretchable bridge portion.

* * * * *